US011236454B2

(12) United States Patent
Li et al.

(10) Patent No.: US 11,236,454 B2
(45) Date of Patent: Feb. 1, 2022

(54) METHOD FOR CONTROLLING RELEASE AMOUNT OF DETERGENT, AND WASHING MACHINE

(71) Applicants: QINGDAO HAIER WASHING MACHING CO., LTD., Qingdao (CN); QINGDAO HAIER SMART TECHNOLOGY R&D CO., LTD., Qingdao (CN)

(72) Inventors: Dong Li, Qingdao (CN); Shilong Hao, Qingdao (CN); Jingjing Zhang, Qingdao (CN); Chunfeng Lao, Qingdao (CN); Sheng Xu, Qingdao (CN); Jinzhu Deng, Qingdao (CN)

(73) Assignees: QINGDAO HAIER WASHING MACHINE CO., LTD., Qingdao (CN); QINGDAO HAIER SMART TECHNOLOGY R&D CO., LTD., Qingdao (CN)

( * ) Notice: Subject to any disclaimer, the term of this patent is extended or adjusted under 35 U.S.C. 154(b) by 200 days.

(21) Appl. No.: 16/628,858

(22) PCT Filed: Jul. 5, 2018

(86) PCT No.: PCT/CN2018/094641
§ 371 (c)(1),
(2) Date: Jan. 6, 2020

(87) PCT Pub. No.: WO2019/007391
PCT Pub. Date: Jan. 10, 2019

(65) Prior Publication Data

US 2020/0232148 A1 Jul. 23, 2020

(30) Foreign Application Priority Data

Jul. 6, 2017 (CN) ..... 201710548008.5

(51) Int. Cl.
*D06F 33/37* (2020.01)
*D06F 39/02* (2006.01)
(Continued)

(52) U.S. Cl.
CPC ..... *D06F 33/37* (2020.02); *D06F 39/02* (2013.01); *D06F 39/022* (2013.01); *D06F 2103/04* (2020.02); *D06F 2105/42* (2020.02)

(58) Field of Classification Search
CPC ..... D06F 33/37
See application file for complete search history.

(56) References Cited

FOREIGN PATENT DOCUMENTS

CN 101935936 1/2011
CN 102409516 4/2012
(Continued)

*Primary Examiner* — Jason Y Ko
(74) *Attorney, Agent, or Firm* — Jiwen Chen; Jacobson Holman PLLC

(57) ABSTRACT

A method for controlling release amount of detergent and a washing device, include: dividing inner space of a detergent box into independent N compartments, wherein each of the compartments is configured to store a type of detergent having a certain concentration range; assigning a concentration level Ci, i=1, . . . , N to each of the compartments wherein the higher the detergent concentration, the lower the concentration level; selecting one of the compartments containing detergent and releasing the detergent in the selected compartment, and obtaining the concentration level C of the selected compartment; obtaining a laundry weight m; and calculating a release amount of the detergent, wherein Vn=1.25*m*(C+1). The formula which is configured to calculate the release amount of detergent is also provided based on both of the detergent concentration level and the laundry weight. Hence, the problem of excess foaming and
(Continued)

residue caused by putting too much concentrated detergents which have to introduce more rinsing cycles could be effectively solved.

10 Claims, 3 Drawing Sheets

(51) Int. Cl.
*D06F 103/04* (2020.01)
*D06F 105/42* (2020.01)

(56) References Cited

FOREIGN PATENT DOCUMENTS

| | | |
|---|---|---|
| CN | 103266452 | 8/2013 |
| CN | 204000327 | 12/2014 |
| CN | 105088687 | 11/2015 |
| CN | 106884283 | 6/2017 |

METHOD FOR CONTROLLING RELEASE AMOUNT OF DETERGENT, AND WASHING MACHINE

CROSS-REFERENCE TO RELATED APPLICATIONS

This is a U.S. national stage application of PCT Application No. PCT/CN2018/094641 under 35 U.S.C. 371, filed Jul. 5, 2018 in Chinese, claiming priority of Chinese Application No. 201710548008.5, filed Jul. 6, 2017, all of which are hereby incorporated by reference.

The invention belongs to the technical field of washing equipment, in particular to a method and a washing machine, which are capable of automatically adjusting how much detergent to release per load according to varied detergent concentrations.

BACKGROUND

The washing machine is particularly designed to wash clothes and other textiles made of cotton, linen and chemical fibers. Typical washing machines, including fully automatic washing machine and semi-automatic washing machine, basically have three functions: washing, rinsing and spinning, which make the cleaning much easier and improve comforts. We all believe that the next generation of washing machine has to keep abreast of the trend of the development of intelligent home appliances, so as to help the user to get the laundry done much more easier.

At the preset stage, smart washing machines sold on the market are mainly equipped with an automatic detergent dispenser or a controller with a WiFi module. Within the automatic detergent dispenser type how much the detergent to use per load is automatically determined according to the weight of the laundry. The determined amount of the detergent is being released into the washer tub during the wash cycles.

However, there are many kinds of detergents available to the users, such as ordinary detergents with a concentration between 15% to 25%, concentrated detergents with a concentration between 25% to 35%, high-concentration detergents with a concentration of 35% to 45%, ultra-concentrated detergents with a concentration above 45% and the like, within which the amount of active contents are different. That means how much of the detergents should be used per load is theoretically varied. If the washing machine still uses the way to determine the amount of the detergent according to the weight of the laundry, it may lead in problems of sparse foaming which cannot clean the laundry properly as using too less detergent or excess foaming which may remain on the laundry and have to introduce more rinsing cycles. These can seriously affect the user's using experience.

SUMMARY OF THE INVENTION

In order to solve the problem that the typical washing machine is not capable of adjusting the amount of detergent according to varied detergent concentrations, a method for controlling release amount of detergent is provided to properly clean the laundry and avoid detergent residue, and there is no need to introduce more rinsing cycles so that much more energy and water is saved.

In one aspect, the present invention provides a method for controlling release amount of detergent, which is applied in a washing device, wherein the method includes: dividing inner space of a detergent box into independent N compartments, wherein each of the compartments is configured to store a type of detergent having a certain concentration range; assigning a concentration level Ci, i=1, . . . , N to each of the compartments wherein the higher the detergent concentration, the lower the concentration level; selecting one of the compartments containing detergent and releasing the detergent in the selected compartment, and obtaining the concentration level C of the selected compartment; obtaining a laundry weight m; and calculating a release amount of the detergent, wherein $Vn=1.25*m*(C+1)$.

Further, the method includes: sequencing the N compartments according to the concentration of the detergent stored from low to high; and assigning a concentration level Ci to each of the compartment according to ranks from 1 to N, and $Ci=N-i+1$.

In order to facilitate the user to accurately put detergents having certain concentration ranges into corresponding compartments, each of the compartments is labeled with the concentration range and the type of the detergent stored therein to advise to put detergents into correct compartments according to the concentration range or the detergent type.

Preferably, the detergents including M types, wherein $M \leq N$; determining M concentration ranges out of N concentration ranges according to the M concentration ranges of the M types of detergents, so as to further improve the dispensing accuracy.

In another aspect, the present invention also provides a washing machine, the washing machine includes a detergent box configured to store detergent is divided into independent N compartments, wherein each of the compartments is configured to store a type of detergent having a certain concentration range; an automatic dispensing device configured to draw a certain amount of detergent from the detergent box to dispense; N solenoid valve(s), wherein one of the solenoid valve is configured to selectively communicate one compartment with the automatic dispensing device; a weight detecting device configured to detect the weight of the laundry in the washing machine; and a control module storing concentration levels Ci, i=1, . . . , N which corresponds to the independent N compartments wherein the higher the detergent concentration, the lower the concentration level; as running washing program, the control module drive one of the solenoid valve to open and obtain the concentration level C of the selected compartment, the control module receive the laundry weight m input from the weight detecting device and calculate a release amount of detergent Vn, $Vn=1.25*m*(C+1)$, and to control the automatic dispensing device to draw corresponding amount of detergent to dispense.

Furthermore, the control module is further configured to sequence the N compartments according to the concentration of the detergent stored from low to high; and to assign a concentration level Ci to each of the compartment according to ranks from 1 to N, and $Ci=N-i+1$.

In order to facilitate the user to accurately put detergents having certain concentration ranges into corresponding compartments, each of the compartments is labeled with the concentration range and the type of the detergent stored therein to advise to put detergents into correct compartments according to the concentration range or the detergent type.

Preferably, the detergents including M types, wherein $M \leq N$; determining M concentration ranges out of N concentration ranges according to the M concentration ranges of the M types of detergents, which in turn further increases the accuracy of the detergent delivery control.

Furthermore, the washing machine further includes a liquid level detecting module mounted on the detergent box and configured to detect the liquid level of N compartments and generate liquid level signal to send to the control module; wherein the control module indentifying the compartments containing detergents therein; if only one compartment containing detergent, then drive the solenoid valve corresponding to the one compartment to open and obtaining the concentration level of the compartment. That is to say, only one of stored detergents in the washing machine is used to wash the laundry automatically.

Furthermore, the washing machine further includes an interface configured to input a compartment selection command; if it is detected that multiple compartments containing detergents, one of the compartments is selected via the interface, then driving the solenoid valve corresponding to the selected compartment to open and obtaining the concentration level of the selected compartment. That is to say, the washing machine automatically uses the detergent having a concentration selected by the user to wash the laundry.

The precise control of the release amount of detergent according to the present invention is relied on a means of dividing the inner space of the detergent dispenser into several independent compartments and each of them is used to store a detergent of a certain concentration range and is respectively assigned to a concentration level. The automatic recognition of the detergent concentration could be achieved by the selection of the specific compartment. A formula which is configured to calculate the release amount of detergent is also provided based on both of the detergent concentration level and the laundry weight. Hence, the problem of excess foaming and residue caused by putting too much concentrated detergents which have to introduce more rinsing cycles could be avoided.

Other features and advantages of the present invention will become more apparent from the detailed description of the embodiments.

DETAILED DESCRIPTION OF THE INVENTION

The specific embodiments of the present invention are described in detail below with reference to the accompanying drawings.

The precise control of the release amount of detergent according to one embodiment of the present invention is relied on a means of dividing the inner space of the detergent dispenser into several independent compartments and each of them is used to store a detergent of a certain concentration range and is respectively assigned to a concentration level. The automatic recognition of the detergent concentration could be achieved by the selection of the specific compartment. A formula which is configured to calculate the release amount of detergent is also provided based on both of the detergent concentration level and the laundry weight. In general, with those arrangements, the detergent to be released per load could be determined properly and accurately. Furthermore the formula could facilitate programming by providing a clear process for software development, which will be fast in execution.

Taking a washing machine as an example of a washing device, the structure of it will be specifically described as follows.

Figure 1:
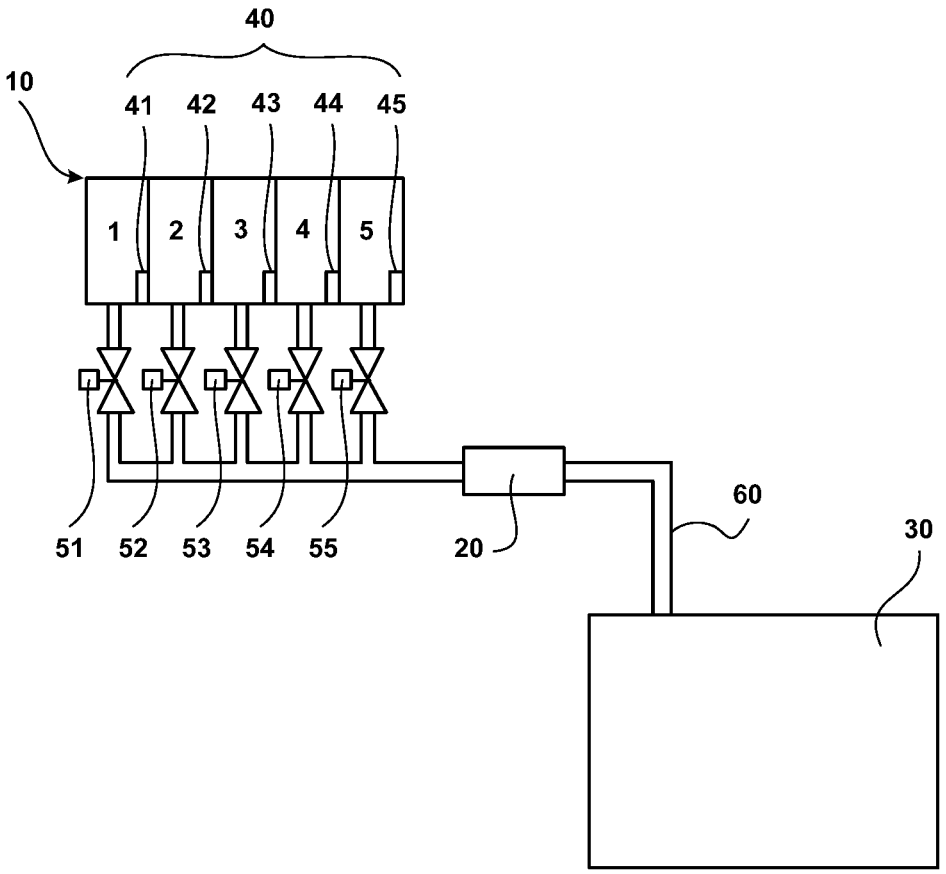
FIG. 1 is a partial structural schematic view of a washing machine according to one embodiment of the present invention.
Figure 2:
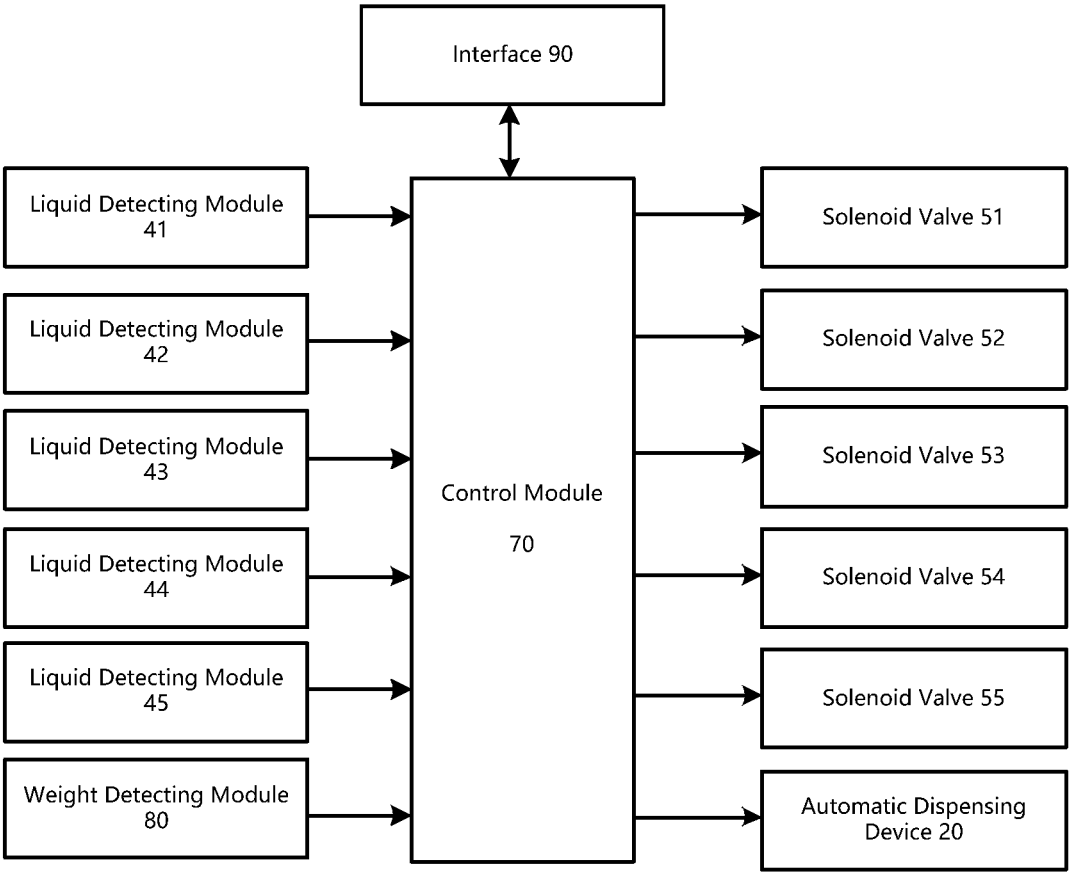
FIG. 2 is a circuit block diagram of the washing machine shown in FIG. 1.

A washing machine according to one embodiment of the present invention is shown in FIG. 1 and FIG. 2. In order to automatically release detergent into, a detergent box 10 capable of storing a certain amount of detergent is disposed in the washing machine. The detergent box 10 is divided into N independent compartments. As shown in FIG. 1, the detergent box 10 is divided into five independent compartments which are respectively denoted as 1, 2, 3, 4, 5 and each of them is configured to store a type of detergent within a certain concentration range. People could accurately put the detergents of varied concentrations into different compartments with the aid of compartment labels which clearly indicate types of the detergents and/or its concentration ranges.

As shown in FIG. 1, the detergent box 10 is divided into five independent compartments which are respectively denoted as 1, 2, 3, 4, 5, wherein a first compartment is configured to store low concentration detergents having a concentration <15%; a second compartment is configured to store normal concentration detergents having a concentration range of 15%~25%; a third compartment is configured to store concentrated detergent with a concentration range of 25%~35%; a fourth compartment is configured to store high concentration detergents having a concentration range of 35%~45%; a fifth compartment is configured to store ultra-high concentration detergents having a concentration >45%. According to the concentration range or the type of detergent identified on its packaging, the user could select a suitable compartment where the detergent is being poured into.

The number of the independent compartments is preferably determined according to the types of detergents sold on the market, and that is to say, if there are M types of detergents sold on the market, at least independent N compartments (i.e., N≥M) are divided into within the detergent box 10 so as to properly store different types of detergents. Considering the concentration range of some foreign detergents may be different from those of domestic clean substances, it is preferably to set the number of the compartments larger than the types of detergents may be used so as to ensure that each of the detergent could be independently stored. Additionally, as to define concentration ranges of varied compartments, it is preferably to determine M concentration ranges out of N concentration ranges according to the M types of detergents available on the market so as to ensure that the determined M concentration ranges corresponds to the types of detergents so as to make the control process more accurate. The compartments used to store the detergents having M concentration ranges are respectively labeled with their concentration ranges and detergent types, and in this way, the user could notice storage positions of different detergents as adding detergents into the detergent box 10. As an example, if there are four types of detergents sold on the domestic market including an ordinary type having a concentration between 15% to 25%, a concentrated type having a concentration between 25% to 35%, a high-concentration type having a concentration of 35% to 45% and an ultra-concentrated type with a concentration above 45%, it is preferably to divide the inner compartment of the detergent box 10 into five compartments, wherein four of the five compartments are configured to respectively store the four types detergents with concentration ranges of 15%~25%, 25%~35%, 35%~45% and >45% which corresponds to four types of detergents sold on the domestic market, and the remaining one is configured to store the detergent having a concentration <15%, so as to meet the requirements to release different detergents into during washing cycles. Those detergents without concentration information on its packaging could be placed into the compartment configured to store the detergent having a concentration <15%, which may deviate from the accurate concentration but at least could ensure that the laundry is cleaned.

A solenoid valve is installed on each of outlets of the compartments or on each of connecting pipes to the outlets. For example, five solenoid valves 51, 52, 53, 54, 55 are required as for the detergent box 10 within which five compartments are divided into, and the five solenoid valves 51, 52, 53, 54, 55 are respectively communicate with the five independent compartments 1, 2, 3, 4, 5. The five solenoid valves 51, 52, 53, 54, 55 are independently controlled so as to release one of the detergents stored in the compartments 1, 2, 3, 4, 5.

In order to release a certain amount of the detergent per load, an automatic dispensing device 20 is also provided in the washing machine. As shown in FIG. 1, an inlet of the automatic dispensing device 20 is respectively connected to the independent N compartments via N inlet pipes. As dividing five compartments as an example, five solenoid valves 51, 52, 53, 54, 55 are respectively arranged on the five inlet pipes. The five solenoid valves 51, 52, 53, 54, 55 are independently controlled so as to communicate corresponding compartment and the automatic dispensing device 20. With this arrangement, the automatic dispensing device 20 could draw a proper amount of detergent from the compartment communicating with and dispense automatically. The automatic dispensing device 20 could be designed by various means available to the public, such as using a venturi tube negative pressure quantitative drawing structure or a quantitative pump automatic drawing structure, and those arrangements are capable of dispensing proper amount of detergents Furthermore, the certain amount of detergent drawn by the automatic dispensing device 20 could be placed into a washing tank 30, or preferably, firstly introduced to an water inlet pipe 60 communicated with the washing tank 30 so as to enable the detergent to be diluted by water and then flow into the washing tank 30, which may be more advantageous for the dissolution and dilution of the detergent in the washing machine.

In order to automatically detect if there are some detergents left in the detergent box 10, a liquid level detecting module 40 is mounted on the detergent box 10. As shown in FIG. 1 and FIG. 2, the liquid level detecting module 40 is configured to detect the variation of liquid level within each of the compartments and generate one or more liquid level signals; the liquid level signals are sent to a control module 70 on a main board of the washing machine so as to automatically detect how much detergents respectively stored in those compartments.

As a preferred embodiment, each of the compartments 1/2/3/4/5 is provided with a liquid level detecting module 41/42/43/44/45. In this way, on one hand, if the detergents in all compartments are used up, the user could be promptly reminded to replenish the detergent box 10; on the other hand, the control module 70 could automatically recognize how much detergents remain in each of the compartments. If it is detected that a certain amount of detergent is left in only one compartment, as the washing machine running the washing program, the control module 70 could automatically drive the corresponding solenoid valve open to communicate the only compartment with the automatic dispensing device 20 and the automatic dispensing device 20 could draw detergent from the compartment and then release into; if it is detected that a certain amount of detergents are left in multiple compartments by the control module 70, an interface 90 of the washing machine is configured to display the number, the detergent concentration ranges or the types of detergents of those compartments to make the user select. The user may select one of the detergents via the interface 90 and the control module 70 is configured to identify which compartment the user selects according to the compartment selection command input by the interface 90, and to drive the corresponding solenoid value open to communicate the select compartment with the automatic dispensing device 20, and the automatic dispensing device 20 could draw detergent from the selected compartment and then release into the washing tank 30.

Furthermore, in the embodiment, a weight detecting module 80 is further mounted on the washing tank 30 for detecting the weight m of the laundry being put into the washing machine, and the weight of the laundry is sent to the control module 70, which is shown in FIG. 2. The control module 70 assigns a concentration level Ci, i=1, . . . , N to each compartment formed in the detergent box 10, and in which the detergent concentration stored is higher, the corresponding concentration level of the compartment is lower. The release amount of detergent Vn is being determined by the control module 70 according to the concentration level Ci where the detergent stored and the laundry weight m, and a certain amount of the selected detergent is being dispensed via the automatic dispensing device 20.

With reference to the structure of the washing machine shown in FIG. 1 and FIG. 2, a method for controlling release amount of detergent is illustrated as follows.

Figure 3:
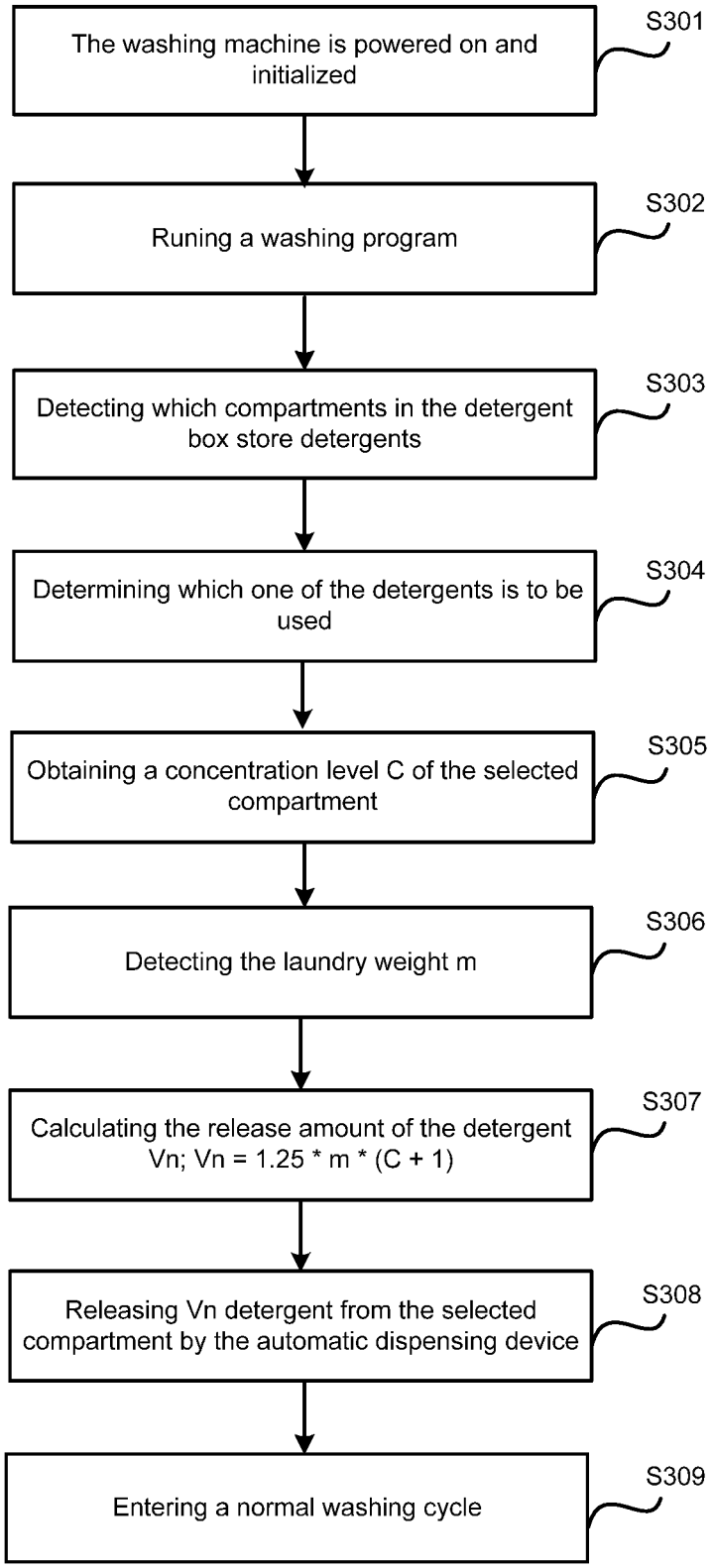
FIG. 3 is a flow chart of a method for controlling release amount of detergent according to one embodiment of the present invention.

As shown in FIG. 3, the method includes the following procedures:

S301, the washing machine is powered on and initialized, and the washing machine detects whether or not the user selects a desired running program.

S302, the washing machine performs the subsequent steps each time as washing program is running.

S303, detecting which compartments in the detergent box 10 store detergents.

In this embodiment, each time as washing program is running, the control module 70 on the main board of the washing machine firstly activates the liquid level detecting module 40 to detect the liquid level of each of the compartments within the detergent box 10, and then identifies which compartments have detergents left.

S304, determining which one of the detergents is to be used.

In the present embodiment, if it is detected by the control module 70 that a certain amount of detergent is left in only one compartment, the control module 70 automatically drives the corresponding solenoid valve open to communicate the only compartment with the automatic dispensing device 20; if it is detected that a certain amount of detergents are left in multiple compartments by the control module 70, an interface 90 of the washing machine is configured to display the compartment numbers, the detergent concentration ranges or the types of detergents of those compartments to make the user select. The user may select one of the detergents via the interface 90 and the control module 70 is configured to identify which compartment the user select and to drive the corresponding solenoid value open to communicate the selected compartment with the automatic dispensing device 20.

S305, obtaining a concentration level C of the selected compartment;

In this embodiment, as designing the program of the washing machine, firstly sequencing the N compartments inside the detergent box 10 according to the concentration of the detergent stored from low to high, that is to say, the rank of the compartment containing a detergent with a lower concentration is higher than that of the compartment containing a detergent with a higher concentration; assigning a concentration level Ci to each of the compartment according to their ranks from 1 to N, and Ci=N−i+1, that is to say the higher the concentration is, the smaller the concentration level is. As an example, N=5, sequencing the five compartments according to the concentration of the detergent stored from low to high, such as in sequence: the first compartment, the second compartment, the third compartment, the fourth compartment and the fifth compartment. In this way, the concentration level of the first compartment C1=5, the concentration level of the second compartment C2=4, the concentration level of the third compartment C3=3, the concentration level of the fourth compartment C4=2, and the concentration level of the fifth compartment C5=1; and the concentration levels of the N compartments are written in the control module 70 for calling by the program.

The control module 70 calls the corresponding concentration level according to the selected compartment, such that if the ith compartment is being selected, then the control module 70 calls the concentration level C=Ci corresponding to the ith compartment.

S306, detecting the laundry weight m;

In the present embodiment, the weight m of the laundry put in the washing machine is being detected by the weight detecting module 80, and the laundry weight m is being sent to the control module 70 to calculate the release amount of the detergent Vn;

S307, using a formula to calculate the release amount of the detergent Vn based on the concentration level C corresponding to the selected compartment and the laundry weight m;

In the present embodiment, the control module 70 substitutes the concentration level C and the weight m of the laundry to the following formula to calculate the amount of detergent Vn:

$$Vn=1.25*m*(C+1).$$

S308, releasing Vn detergent from the selected compartment by the automatic dispensing device 20;

In this embodiment, according to the calculated release amount of detergent Vn, the control module 70 controls the automatic dispensing device 20 to draw Vn detergent from the selected compartment and then put into the washing tank 30 or introduce to the inlet pipe 60 to achieve quantitative dispense of detergent.

S309, entering a normal washing cycle;

The invention combines the concentration level of the detergent and the weight of the laundry to determine the release amount of the detergent with a formula, the method is simple and easy to implement and the calculated release amount is accurate. The present invention can also be applied to other washing apparatuses other than the washing machine, and the same or similar technical effects can be obtained as well.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What we claimed is:

1. A method for controlling release amount of detergent, which is applied in a washing device, wherein the method comprises:

dividing inner space of a detergent box configured to store detergents in the washing device into independent N compartments, wherein each of the compartments is configured to store a type of detergent having a certain concentration range;

assigning a concentration level Ci, i=1, . . . , N to each of the compartments wherein the higher the detergent concentration, the lower the concentration level;

selecting one of the compartments containing detergent to release the detergent therein, and obtaining the concentration level C of the selected compartment;

obtaining a laundry weight m; and calculating a release amount of the detergent Vn, wherein Vn=1.25 * m * (C+1).

2. A method for controlling release amount of detergent according to claim 1, wherein sequencing the N compartments according to the concentration ranges of the detergents stored from low to high; and assigning a concentration level Ci to each of the compartment according to the ranks from 1 to N, and Ci=N−i+1.

3. A method for controlling release amount of detergent according to claim 1, wherein each of the compartments is labeled with the concentration range and/or the type of the detergent stored therein to advise to put detergents into correct compartments according to the concentration range or the detergent type.

4. A method for controlling release amount of detergent according to claim 3, wherein the detergents including M types, wherein M≤N; determining M concentration ranges out of N concentration ranges according to the M concentration ranges of the M types of detergents.

5. A washing machine comprising:

a detergent box configured to store detergent is divided into independent N compartments, wherein each of the compartments is configured to store a type of detergent having a certain concentration range;

an automatic dispensing device configured to draw a certain amount of detergent from the detergent box to dispense;

N solenoid valve(s), wherein one of the solenoid valve is configured to selectively communicate one compartment with the automatic dispensing device;

a weight detecting device configured to detect the weight of the laundry in the washing machine; and a control module storing concentration levels Ci, i=1, . . . , N which corresponds to the independent N compartments wherein the higher the detergent concentration, the lower the concentration level; as running washing program, the control module configured to drive one of the solenoid valve to open and obtain the concentration level C of the selected compartment, and to receive the laundry weight m input from the weight detecting device and calculate a release amount of detergent Vn, Vn=1.25 * m * (C+1), and to control the automatic dispensing device to draw corresponding amount of detergent to dispense.

6. A washing machine according to claim 5, wherein the control module is further configured to sequence the N compartments according to the concentration of the detergent stored from low to high; and assign a concentration level Ci to each of the compartment according to ranks from 1 to N, and Ci=N−i+1.

7. A washing machine according to claim 6, wherein each of the compartments is labeled with the concentration range and the type of the detergent stored therein to advise to put detergents into correct compartments according to the concentration range or the detergent type.

8. A washing machine according to claim 7, wherein the detergents including M types, wherein M≤N; determining M concentration ranges out of N concentration ranges according to the M concentration ranges of the M types of detergents.

9. A washing machine according to claim 5, further comprising:

a liquid level detecting module mounted on the detergent box and configured to detect the liquid level of N compartments and generate liquid level signal to send to the control module;

wherein the control module indentifying the compartments containing detergents therein; if only one compartment containing detergent, then driving the solenoid valve corresponding to the one compartment to open and obtaining the concentration level of the compartment.

10. A washing machine according to claim 9, wherein includes:

an interface configured to input a compartment selection command;

if it is detected that multiple compartments containing detergents, one of the compartment is selected via the interface, then driving the solenoid valve corresponding to the selected compartment to open and obtaining the concentration level of the selected compartment.

* * * * *